US008002441B2

(12) United States Patent
Barkdoll et al.

(10) Patent No.: US 8,002,441 B2
(45) Date of Patent: Aug. 23, 2011

(54) ADJUSTABLE ARM GONDOLA LIGHTING SYSTEM

(75) Inventors: Patrick J. Barkdoll, Pecatonica, IL (US); Thomas E. Valiulis, Rockford, IL (US); Robert Louis Northrup, Jr., Machesney Park, IL (US)

(73) Assignee: Southern Imperial, Inc., Rockford, IL (US)

( * ) Notice: Subject to any disclaimer, the term of this patent is extended or adjusted under 35 U.S.C. 154(b) by 314 days.

(21) Appl. No.: 12/247,322

(22) Filed: Oct. 8, 2008

(65) Prior Publication Data

US 2010/0085757 A1 Apr. 8, 2010

(51) Int. Cl.
*F21V 21/30* (2006.01)

(52) U.S. Cl. ..... 362/287; 362/282; 362/285; 362/370; 362/423; 362/452

(58) Field of Classification Search ..... 362/287, 362/282, 285, 370, 423, 427, 452, 432; 248/201, 248/316.8, 278.1, 283.1, 292.12
See application file for complete search history.

(56) References Cited

U.S. PATENT DOCUMENTS

| | | | | |
|---|---|---|---|---|
| 3,305,204 | A * | 2/1967 | Babin | 248/278.1 |
| 3,805,053 | A * | 4/1974 | Julinot | 362/223 |
| 4,642,741 | A * | 2/1987 | Cohn | 362/320 |
| 4,949,232 | A * | 8/1990 | Safyan | 362/218 |
| 5,012,394 | A * | 4/1991 | Woodward | 362/198 |
| 6,604,842 | B2 * | 8/2003 | Griffiths | 362/277 |
| 6,663,267 | B2 * | 12/2003 | Newhouse et al. | 362/431 |
| 6,827,465 | B2 | 12/2004 | Shemitz et al. | |
| 7,296,914 | B1 * | 11/2007 | Russello et al. | 362/285 |
| 7,309,137 | B2 * | 12/2007 | Chan | 362/184 |
| 7,575,336 | B2 * | 8/2009 | Yoshida et al. | 362/147 |
| 2004/0208798 | A1 * | 10/2004 | Splane et al. | 422/121 |
| 2007/0177393 | A1 * | 8/2007 | Hirata | 362/392 |

* cited by examiner

*Primary Examiner* — James Lee
*Assistant Examiner* — Mark Tsidulko
(74) *Attorney, Agent, or Firm* — Reinhart Boerner Van Deuren P.C.

(57) ABSTRACT

An adjustable arm gondola lighting system is provided. The adjustable arm gondola lighting system allows a user to illuminate retail merchandise located on a vertical wall by angularly and linearly adjusting the positioning of a light element of the adjustable arm gondola lighting system. The adjustable arm gondola lighting system may integrate a light shade which may include advertising by having printed graphics thereon. The light shade can be positioned around or within a light element to adjust the lighting characteristics of the adjustable arm gondola lighting system.

9 Claims, 16 Drawing Sheets

ADJUSTABLE ARM GONDOLA LIGHTING SYSTEM

FIELD OF THE INVENTION

This invention generally relates to retail display lighting systems. More particularly, this invention relates to retail display lighting systems used to illuminate retail merchandise situated on a vertical retail wall.

BACKGROUND OF THE INVENTION

Adequate lighting of retail merchandise can be a critical element in effective retail sales. Consumers are typically drawn to retail merchandise that is illuminated such that the merchandise is easily and quickly identified. Therefore, a retail sales establishment may potentially increase the sale of certain retail merchandise by ensuring that the merchandise is effectively illuminated and thus easily and quickly identified by a typical consumer.

Many known retail display lighting systems are used in combination with retail merchandise structures. These systems typically include a pair of support arms, a light element held between the support arms, and mounting hardware and features to affix the support arms to the vertical retail wall. Typically, the support arms extend generally perpendicular to the retail wall at a fixed distance therefrom. The light element is affixed to the free end of the support arms, and therefore also located at a fixed distance from the retail wall. Because the length of the support arms governs one aspect of locating the light, there is a limitation on the functionality of the lighting systems. Light is focused on the retail merchandise located near the end of the supports mounted to the vertical wall, but not merchandise located further away from the end of the supports, resulting in inadequate illumination for some of the retail merchandise. This is particularly an issue when retail merchandise located near the illuminated area is removed by a consumer, leaving the remainder of the retail merchandise in a region having less than desirable illumination.

Moreover, known retail display lighting systems tend to lack in aesthetic appeal because they are assembled from relatively large non-decorative components and have exposed wiring.

A further limitation on the current state of the art is an inability to integrate retail merchandise advertising into these lighting systems, resulting in a retail display having an undesirable plain and ultimately non-functional appearance.

Another limitation of current retail display lighting systems relates to their assembly. Current retail display lighting systems typically require assembly in the retail environment. Assembly in this fashion can require several personnel and a significant amount of labor. This labor intensive assembly also inefficiently uses a portion of the retail space for assembly purposes and not for retail sales.

There exists, therefore, a need in the art for a retail display lighting system that can be adjusted to effectively illuminate differing types, sizes, amounts and locations of retail merchandise displayed on retail display systems. It would also be desirable that such a retail display lighting system integrate retail merchandise advertising, thus presenting a consumer with an aesthetically pleasing yet functional appearance. It would further be desirable that such a retail display lighting system be designed for quick and cost effective assembly.

BRIEF SUMMARY OF THE INVENTION

The present invention has several aspects that may be claimed and stand as patentable independently and individually or in combination with other aspects, including but not limited to the following.

In one embodiment of the invention provides a adjustable retail light that can integrate merchandise advertising thereon while providing a user the capability to adjust the light angularly and linearly with respect to a vertical retail wall. The adjustable retail light has two adjustable support arms, a light element contained between and held by the adjustable support arms, and a light shade. The light shade has an inner surface, and the light tube has an outer surface. The inner surface and the outer surface are in contact with one another, and the light shade is capable of being axially rotated with respect to the light tube. In an alternative embodiment, the light shade will be positioned within the light tube.

An other embodiment of this aspect incorporates retail merchandise advertising printed on the light shade. Further, the light shade may have a lens area of clear material thereon such that light emitted from the light element is focused through the lens area. The light passing through the lens area may be selectably directed at the retail merchandise by rotating the light shade with respect to the light tube.

In another subsidiary embodiment of this aspect, the adjustable retail light may incorporate two light tubes. The two light tubes are collinear with one another and share a common adjustable support arm.

In another aspect, an embodiment of the invention provides an adjustable retail lighting system. The adjustable retail lighting system according to this aspect allows a user to angularly and linearly adjust the position of a light element of the adjustable retail lighting system. The adjustable retail lighting system according to this aspect includes a pair of adjustable support arms, and a light element connected to and supported by the pair of adjustable support arms. The pair of adjustable support arms are telescopically adjustable such that an axial length of the pair of adjustable support arms is capable of being lengthened and shortened. The pair of adjustable support arms are also capable of angular adjustment with respect to the vertical wall.

In yet another aspect, an embodiment of the invention provides a method for selectably positioning a light element with respect to a vertical retail wall. The method includes the steps of angularly adjusting a pair of support arms with respect to a vertical retail wall and then telescopically adjusting the length of the pair of support arms.

Other embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
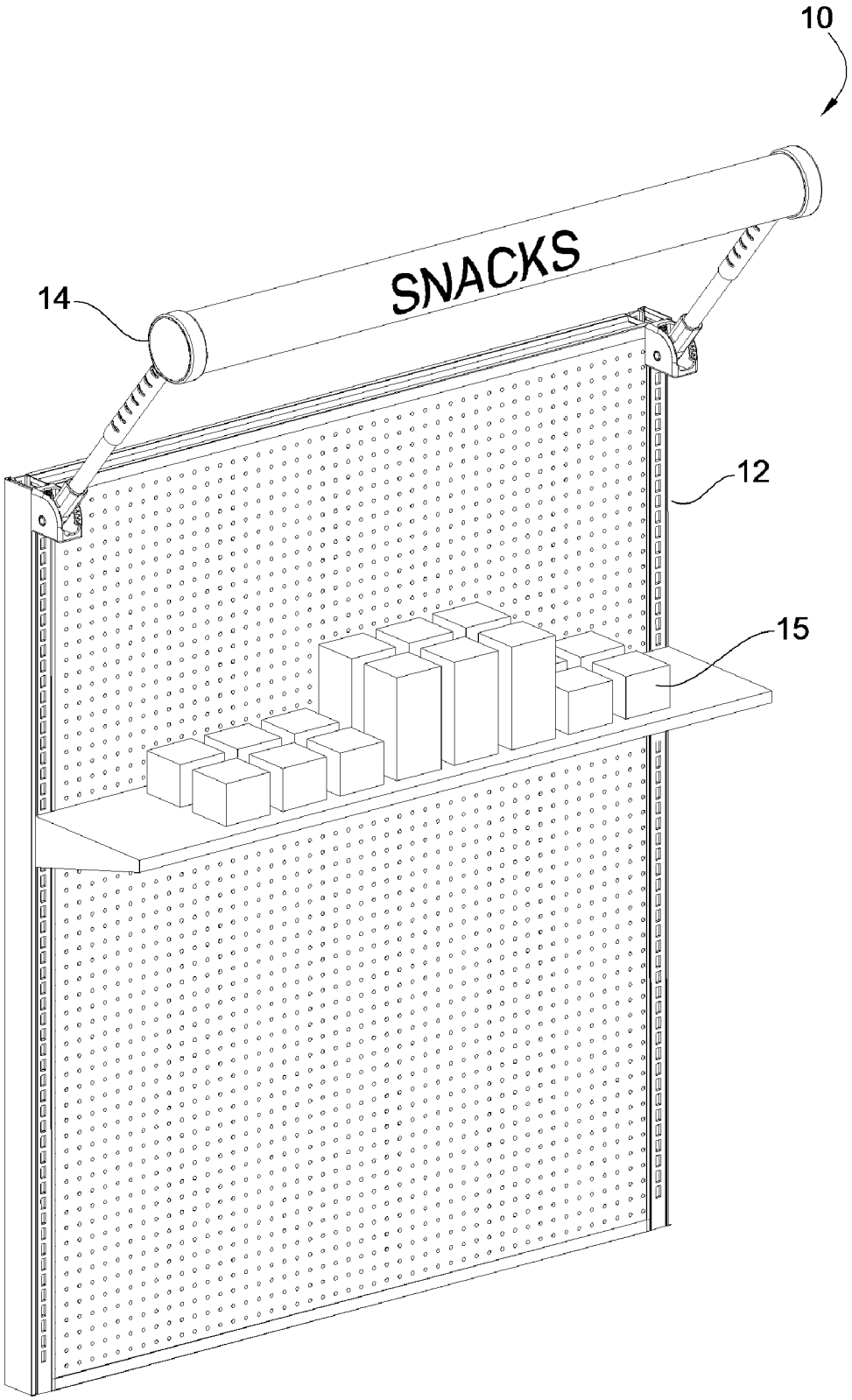
FIG. 1 is an exemplary embodiment of an adjustable arm gondola lighting system in accordance with the teachings of the present invention.

An embodiment of a gondola merchandise display system 10, according to the teachings of the present invention, is illustrated in FIG. 1. As illustrated, the gondola merchandise display system 10 is a retail merchandise structure having a vertical retail wall 12 and an adjustable retail light 14. In the illustrated embodiment, the vertical retail wall is a gondola. The adjustable retail light 14 is used to illuminate retail merchandise 15 situated on the vertical retail wall 12 by virtue of shelving, wire hook assemblies, etc. As will be discussed in detail below, a user can adjust the position or orientation of the adjustable retail light 14 angularly and linearly to effectively illuminate the retail merchandise 15. Although illustrated in the particular embodiment mounted to a vertical retail wall 12 such as a gondola, in other embodiments, the adjustable retail lighting system 12 may be mounted to any vertical wall or to other shelving arrangements.

Figure 2:
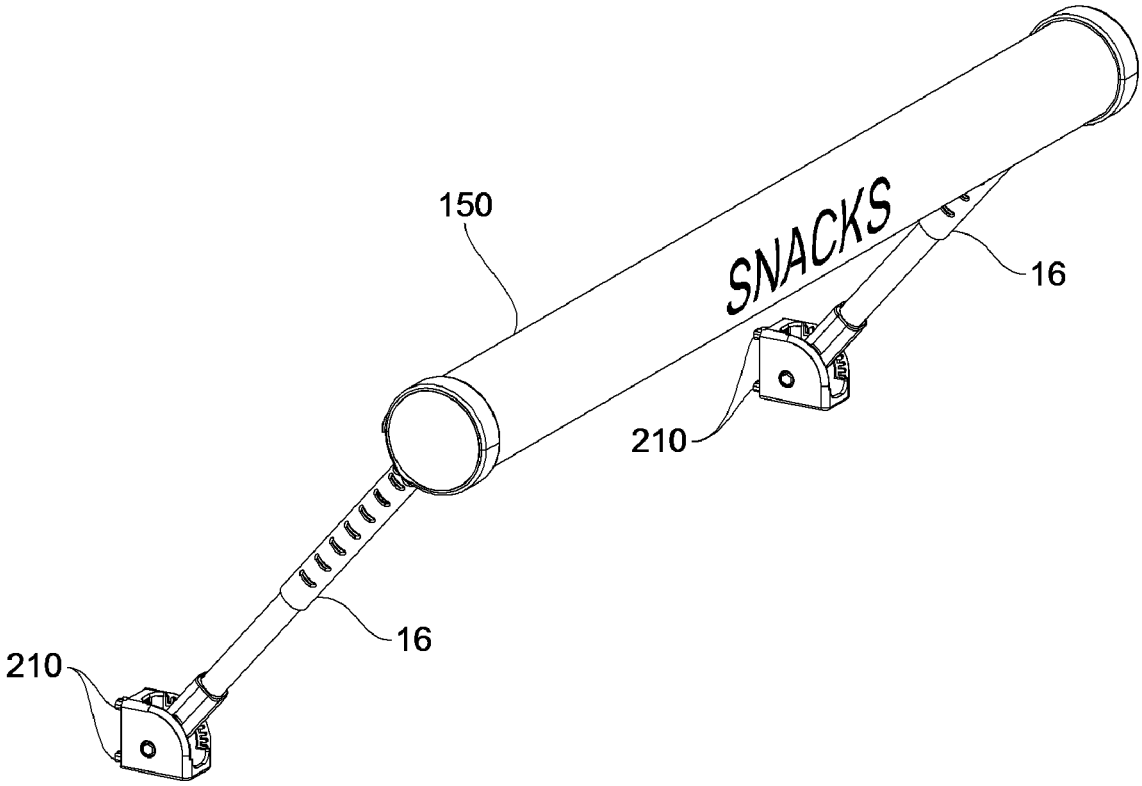
FIG. 2 is a perspective view of an adjustable retail light of the adjustable arm gondola lighting system of FIG. 1.

Referring to FIG. 2, the adjustable retail light 14 includes two adjustable support arms 16 in opposed space relation to one another, a light element 150 interposed between and operatively connected to the adjustable support arms 16, and four mounting key assemblies 210 used to affix the adjustable support arms 16 to the vertical retail wall 12 (See FIG. 1). Each of the above components will be defined structurally in turn, followed by a detailed description of the functionality of the adjustable retail light 14. While the following description of the illustrated embodiments of the invention refers to a retail light 14 using two adjustable support arms 16, in other embodiments the retail merchandise light 14 may utilize one adjustable support arm 16 to affix, support, and position the light element 150 in a cantilevered arrangement.

Figure 3:
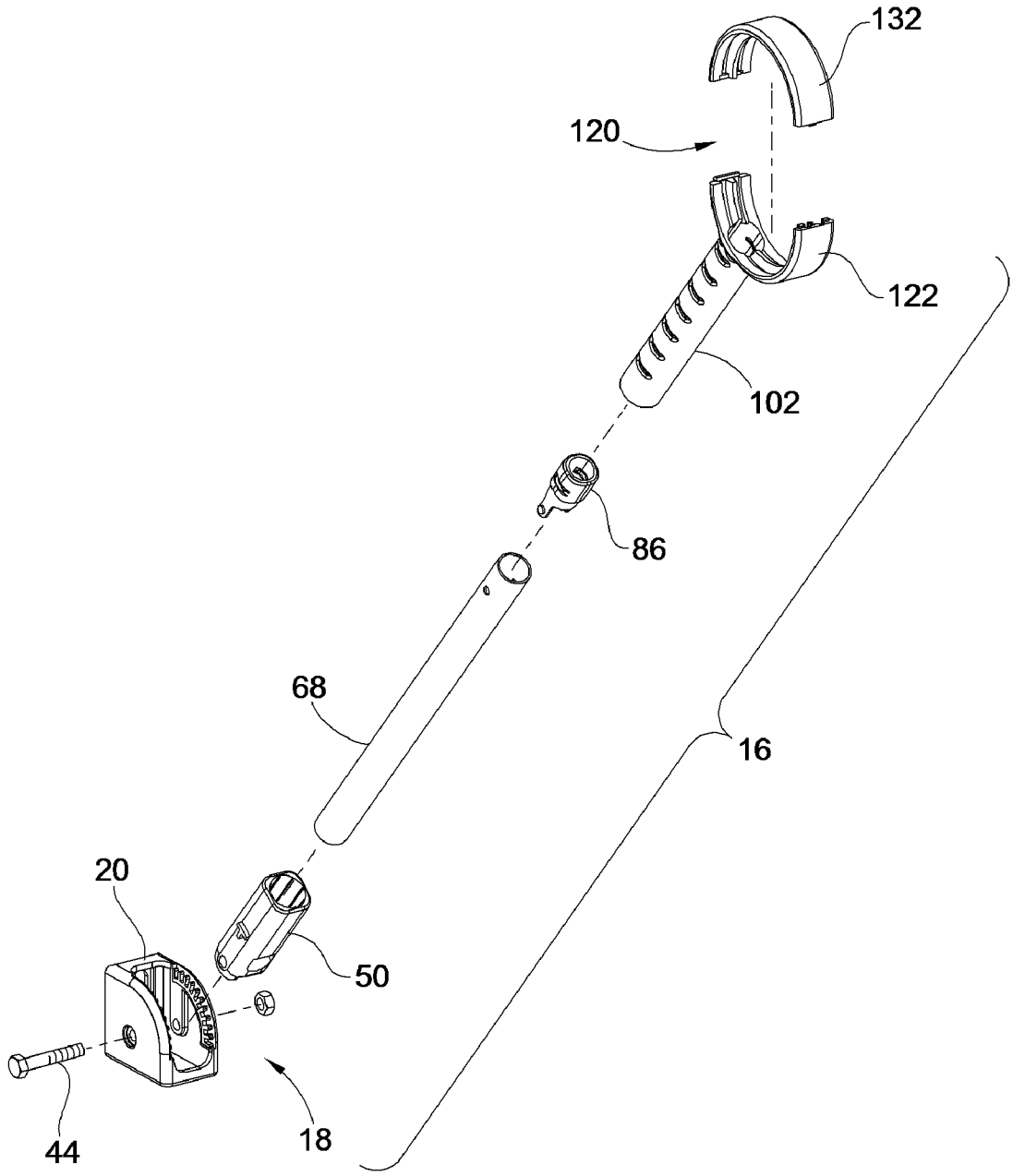
FIG. 3 is an assembly view of an adjustable support arm of the adjustable retail light of FIG. 2.

Turning now to FIG. 3, the adjustable support arm 16 is illustrated in an exploded view. As illustrated, the adjustable support arm 16 includes an inner arm member 68, a locking clip 86, an outer arm member 102 with a mounting coupling 120, and a mounting bracket assembly 18, which includes a bracket housing 20 and a locking sleeve 50. The mounting coupling 120 includes a light tube mounting bracket 122 and a retaining bracket 132.

Figure 4:
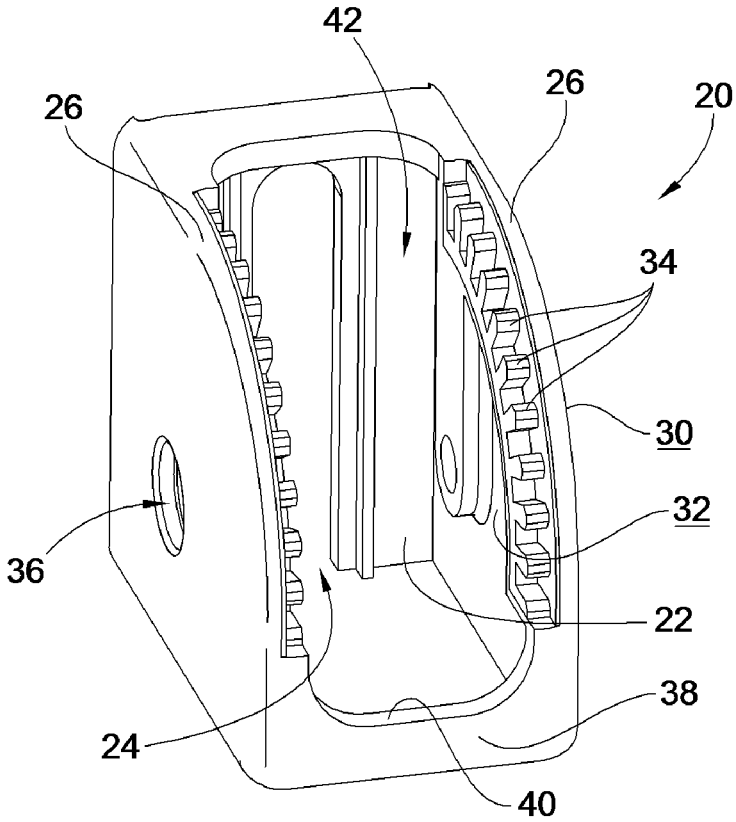
FIG. 4 is a perspective view of a bracket housing of a mounting bracket of the adjustable support arm of FIG. 3.

Referring now to FIG. 4, an embodiment of the bracket housing 20 is illustrated having a pair of side walls 26 in opposed generally parallel, spaced relation to one another. Each side wall 26 extends between an outer face 30 and an inner face 32. As illustrated, one edge of each of the side walls 26 has an arcuate shape, and thus the side profile of the bracket housing 20 generally resembles the quadrant of a circle. Interposed between the side walls 26 and generally transverse to and connected to their arcuate edge is a front wall 38. As will be discussed in more detail below, the front wall 38 has a slotted opening 40 extending through the front wall 38 for receipt of the locking sleeve 50 (See FIG. 3). In other embodiments, the opening may merely be formed by and between the two sidewalls 26. Also interposed and generally transverse to the side walls 26 is the rear wall 22. As will be discussed in more detail below, the rear wall 22 has an open ended slot 24 extending through the rear wall 22 for receipt of the mounting key assemblies 210 (See FIG. 3). The side walls 26, front wall 38, and rear wall 22 together bound a locking sleeve chamber 42 that has an open bottom. A second end 62 (See FIG. 5) of the locking sleeve 50 is received in the locking sleeve chamber 42. Although illustrated as having a generally arcuate profile when viewed from the side, the bracket housing 20 may also have other geometric profiles such as rectangular, elliptical, etc. Further, the bracket housing 20 need not include front wall 38.

Still referring to FIG. 4, the inner face 32 of each side wall 26 has a plurality of serrated projections 34 (i.e. teeth) thereon, generally resembling a portion of a conventional gear. The serrated projections 34 extend away from inner face 32. As will be discussed in more detail below, the serrated projections 34 cooperate with locking sleeve 50 to allow for angular positioning of the adjustable support arm 16 (See FIG. 2).

Referring now to FIGS. 3 and 4, extending through each side wall 26 is a through hole 36, which may incorporate a counter bore or counter-sink, and is sized for receipt of a bolt 44 in a clearance fit orientation. As will be described in more detail below, the bolt 44 is used to connect the locking sleeve 50 to the bracket housing 20 such that the locking sleeve 50 may be angularly positioned between the extremities of the slotted opening 40, wherein the axis of angular rotation is the center axis of the bolt 44. As illustrated in FIG. 3, the bolt 44 passes concentrically through the through hole 36 of the side walls 26 and a through hole 56 of the locking sleeve 50 (See FIG. 5). Although illustrated as using a bolt 44, those skilled in the art will recognize that other components, e.g. a pin, screw, press fit shaft, etc. may also be used to connect the locking sleeve 50 to the bracket housing 20.

Figure 5:
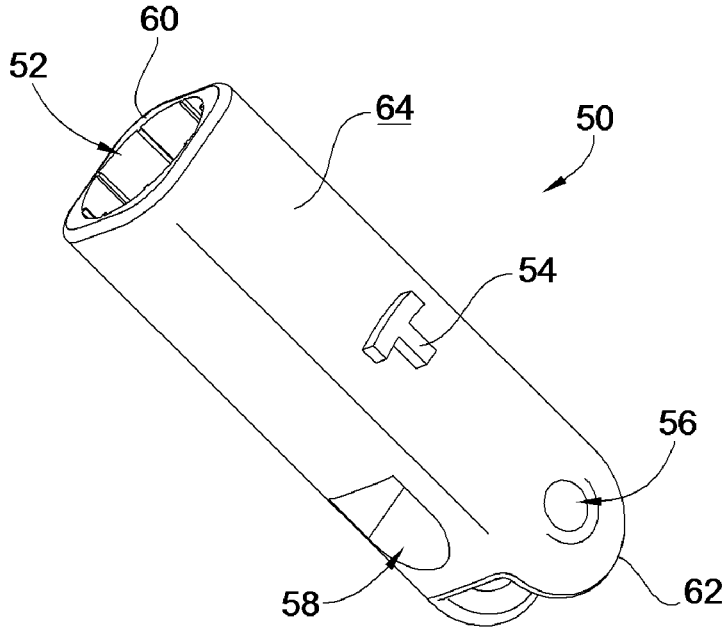
FIG. 5 is a perspective view of a locking sleeve of the mounting bracket of the adjustable support arm of FIG. 3.
Figure 6:
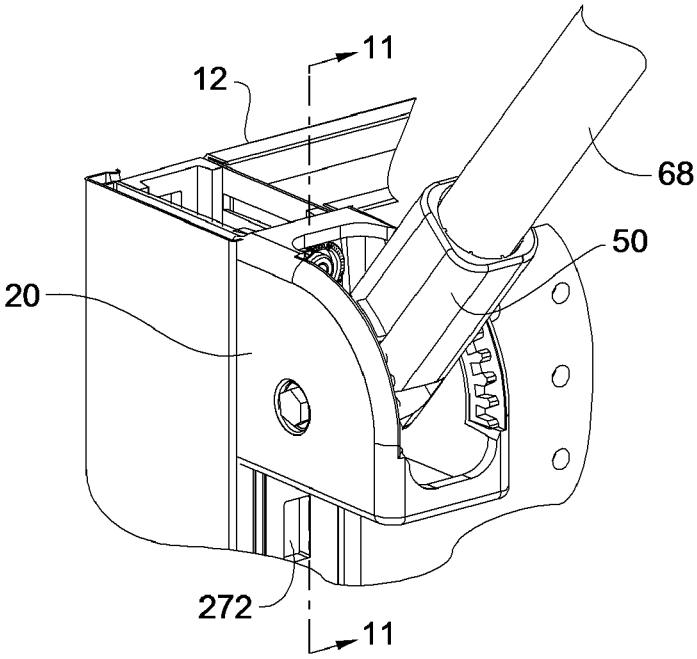
FIG. 6 is a perspective view of the mounting bracket comprised of the bracket housing and locking sleeve of FIGS. 4 and 5.

Turning now to FIG. 5, an embodiment of the locking sleeve 50 is illustrated as having a first end 60 and a second end 62. There is an axial bore 52 beginning at the first end 60 and extending axially inward into the locking sleeve 50. The axial bore 52 is sized to receive a second end 72 of the inner arm member 68 (See FIG. 8), preferably, in a slip fit orientation. In one embodiment, the axial bore 52 and second end 72 of the inner arm member 68 include cooperating structures that prevent rotation of the inner arm member 68 within axial bore 52. The second end 62 of the locking sleeve 50 has a generally arcuate profile, and a through hole 56 that passes through the locking sleeve 50 in proximity to the second end 62. As illustrated, there is a power cord opening 58 in proximity to the second end 62 on a portion of the body of the locking sleeve 50 that extends from an outer surface 64 of the locking sleeve 50 into the axial bore 52.

Still referring to FIG. 5, the locking sleeve 50 has a pair of keyed projections 54 in opposed spaced relation to one another and extending away from the body of the locking sleeve 50. The keyed projections 54 are sized and located to correspond with each plurality of serrated projections 34 contained on the inner faces 32 of the bracket housing 20 (See FIG. 4) when the locking sleeve 50 is received by the bracket housing 20.

Figure 7:
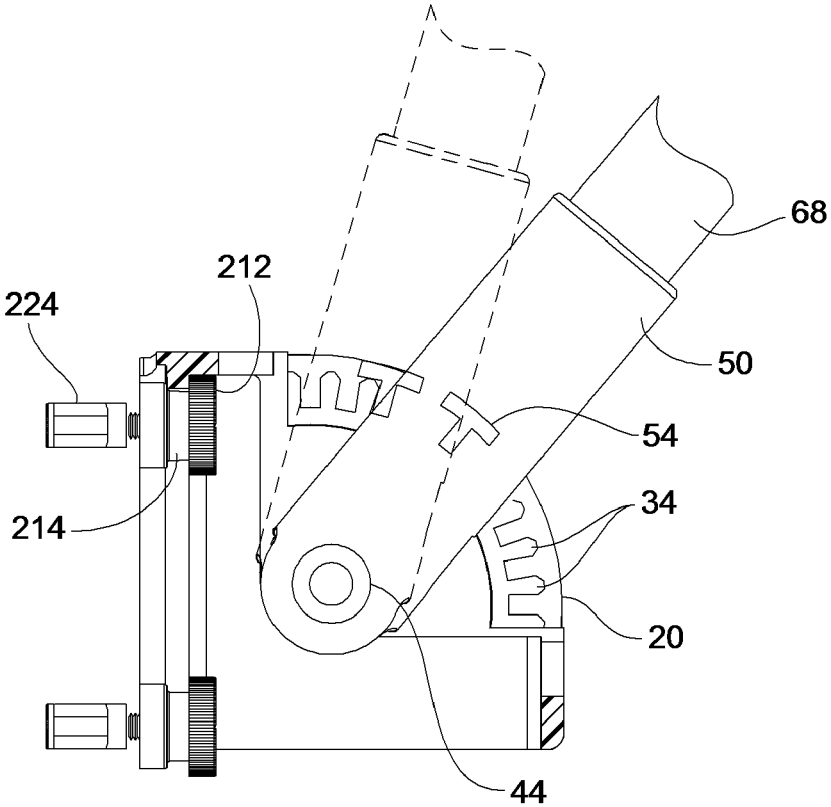
FIG. 7 is a side detail view of the mounting bracket of FIG. 6.

Turning now to FIG. 7, when the locking sleeve 50 and bracket housing 20 are joined via bolt 44, the keyed projections 54 are disposed between adjacent serrated projections 34 of the inner faces 32. Therefore, the pair of keyed projections 54 and the plurality of serrated projections 34 in combination define a finite number of possible angular locations of the locking sleeve with respect to bracket housing 20 and consequently the vertical retail wall 12 (See FIG. 1). As will be discussed in more detail below, the locking sleeve 50 may be selectably positioned and repositioned angularly with respect to bracket housing 20 and consequently the vertical retail wall 12. The locking sleeve 50 and bracket housing 20 may be constructed of a formed plastic, metal, or other structurally rigid material.

Figure 8:
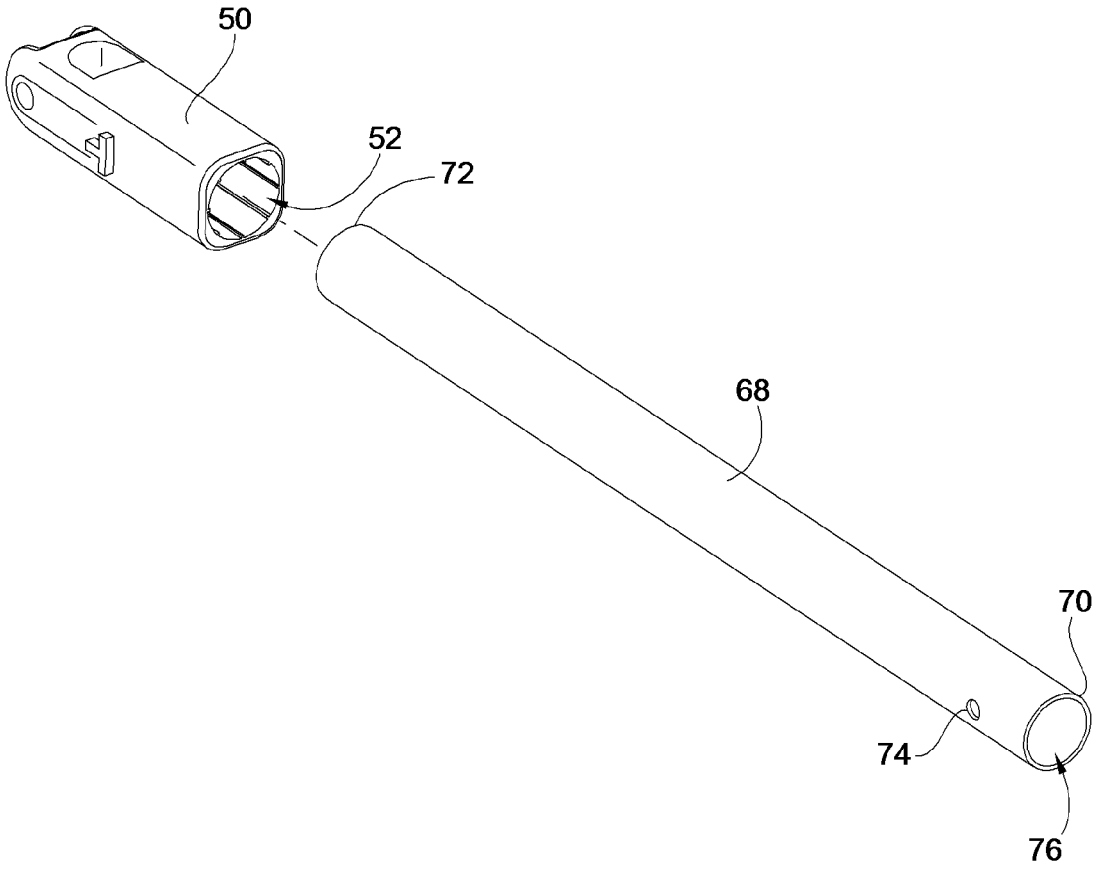
FIG. 8 is an assembly view of the locking sleeve and an inner arm member of the adjustable support arm of FIG. 3.

Referring to FIG. 8, the inner arm member 68 is illustrated as having a generally cylindrical body with a first end 70, a second end 72, an axial bore 76 extending between first and second ends 70, 72, and a hole 74 proximal to the first end 70 and passing through the inner arm member 68. As illustrated, the second end 72 is received by the axial bore 52 of the locking sleeve 50 in a slip fit orientation. The locking sleeve 50 and inner arm member 68 are sized such that the when the second end 72 is fully received by the locking sleeve 50, there is enough frictional contact between the surface of the axial bore 52 and the inner arm member 68 to maintain the inner arm member 68 in place during regular operation of the adjustable retail light 14. The inner arm member 68 may be constructed of a formed plastic, metal, or other structurally rigid material.

Figure 9:
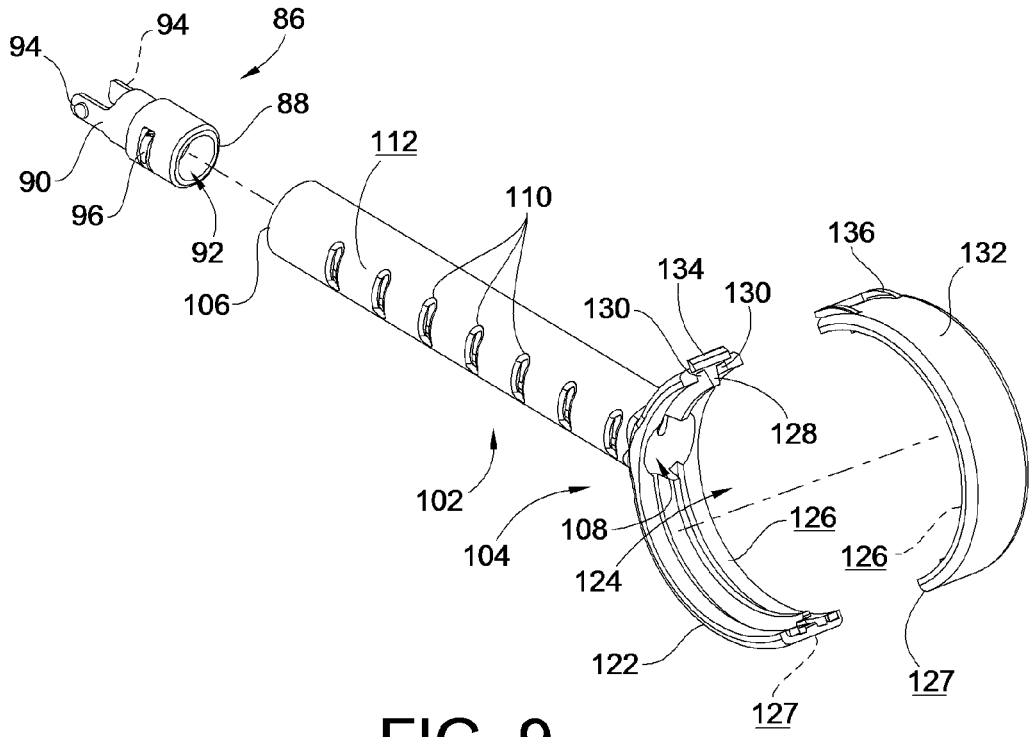
FIG. 9 is an assembly view of a locking clip and an outer arm member of the adjustable support arm of FIG. 3.

Referring now to FIG. 9, the locking clip 86 and outer arm member 102 are illustrated in an exploded view. As illustrated, the locking clip 86 has a generally cylindrical body with a first end 88, and a second end 90. The first end 88 has a circular periphery that is larger than a circular periphery of the second end 90, resulting in the locking clip 86 having a "stepped" appearance. An axial bore 92 extends between the first and second ends 88, 90 and is axially open at the first end 88. A pair of mounting hubs 94 in opposed spaced relation to one another and extending away from the cylindrical body are located at the second end 90. Proximal to the first end 88 are a pair of locking tabs 96 in opposed spaced relation to one another extend away from the cylindrical body. The second end 90 of the locking clip 86 is sized in diameter such that the axial bore 76 (See FIG. 8) of the inner arm member 68 receives the second end 90. When the inner arm member 68 receives the second end 90 of the locking clip 86, the inner arm member 68 and locking clip 86 are axially concentric, and thus have a common center axis. The first end 88 is still exposed exterior to the inner arm member 68 once the second end 90 has been received by the inner arm member 68. Once locking clip 86 is fully received by the inner arm member 68, the mounting hubs 94 are located within the holes 74 of the inner member. Installed as such, the locking clip 86 is prevented from angular rotation about or axial movement along the common longitudinal axis of the inner arm member 68 and the locking clip 86, thereby fixedly securing the locking clip 86 to the inner arm member 68. As will be discussed in more detail below, the locking clip 86 functions as a union between the inner arm member 68 and outer arm member 102. The locking clip 86 may be constructed of a formed plastic, metal, or other structurally rigid material.

An embodiment of the outer arm member 102 is illustrated as having a generally cylindrical body with a first end 104 including the mounting coupling 120, a second end 106, and an axial bore 108. As illustrated, there is a pair of pluralities of slotted openings 110 in diametrically opposed spaced relation to one another, i.e. one on each side of outer arm member 102, along the length of the outer arm member 102 and extending between an outer surface 112 and the axial bore 108.

The axial bore 108 of the outer arm member 102 is sized such that the second end 106 of the outer arm member 102 receives the first end 88 of the locking clip 86 and the inner arm member 68. When the first end 88 of the locking clip 86 is received by the second end 106 of the outer arm member 102, the locking tabs 96 are received by a pair of slotted openings 110 in diametrically opposed space relation to one another.

The locking clip 86 is designed such that when the first end 88 is received by the second end 106 of the outer arm member 102, the locking tabs 96 may be pushed radially inward by a user to allow the axial bore 108 to freely slide over them until the locking tabs are no longer eclipsed by the outer arm member 102 and visible through the next pair of radially adjacent slotted openings 10. Once the locking tabs 96 are no longer eclipsed by the outer arm member 102 and visible through the slotted openings 110, they will return to their neutral radial position, and extend into and engage the pair of slotted openings 110. As such, the outer arm member 102 will then be axially locked in place and mutually concentric with the locking sleeve 50, inner arm member 68, and locking clip 86. As will be discussed in more detail below, by adjusting which pair of slotted openings 110 receive locking tabs 96, the outer arm member 102 may be selectably positioned axially along the inner arm member 68, thereby increasing or decreasing the overall length of the adjustable support arm 16. The outer arm member 102 may be constructed from a formed plastic, metal, or other structurally rigid material.

Still referring to FIG. 9, an embodiment of the mounting coupling 120 is illustrated in an exploded view as extending between an inner surface 126 and an outer surface 127. The mounting coupling 120 is comprised of a mounting bracket 122 and a retaining bracket 132. As illustrated, the mounting coupling 120 has a generally circular periphery with an axial bore 124, wherein the mounting bracket 122 and retaining bracket 132 each form a half of the circular periphery. As illustrated, a tab 134 is located on the outer surface 127 of the mounting bracket 122 and extends transversely therefrom. A hook 136 is located on the outer surface 127 of the retaining bracket 132 and extends transversely therefrom. The hook 136 is adapted to engage the tab 134, thereby joining the mounting bracket 122 with the retaining bracket 132. The tab 134 and hook 136 are configured to be repeatedly joined, such that the mounting coupling 120 may be repeatedly separated into its constituent halves, i.e. the mounting bracket 122 and the retaining bracket 132. The mounting bracket 122 and retaining bracket 132 may also be joined by other methods such as a clip, clamp, or other similar mechanism. Further, the structure including the tab 134 and hook 136 could be reversed.

In the illustrated embodiment of FIG. 9, the mounting coupling 120 has an annular rib 128 extending generally transverse to the interior surface 126. A pair of annular channels 130 are in opposed spaced relation to one another and are located on the interior surface 126 on either side of the annular rib 128. When the mounting bracket 122 and retaining bracket 132 are joined via the tab 134 and hook 136, the annular rib 128 and annular channels 130 are continuous and uninterrupted about the interior surface 126.

Figure 10:
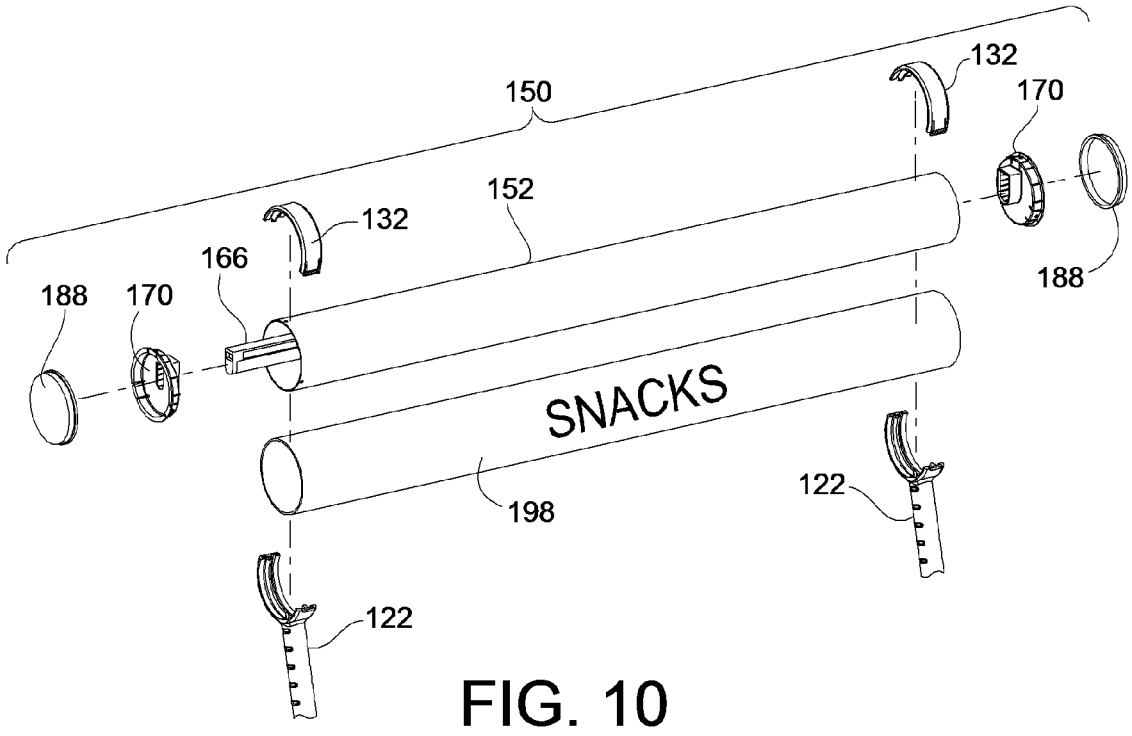
FIG. 10 is an assembly view of a light element of the adjustable retail light of FIG. 2.

Turning now to FIG. 10, a light element 150 comprised of a light tube 152 and a light emitting device 166 is illustrated. A pair of end caps 170, a pair of end cap covers 188, and a light shade 198 are also illustrated assembled to the light element 150. The pair of end caps 170 are in opposed spaced relation to one another and located at opposite ends of the light tube 152. The light emitting device 166 is interposed between and held by the pair of end caps 170. The pair of end caps 170 are covered by the pair of end cap covers 188. The shade 198 is concentric with the light tube 152, and designed to cover the light tube 152 as illustrated. Although illustrated as an independent light bulb, the light emitting device 166 may take other forms that those skilled in the art will recognize, such as a ballast and halogen gas arrangement or an LED arrangement, or other light emitting structures. In some embodiments, a light element 150 may merely be provided by a light emitting device 166 and need not include an outer light tube 152.

The light element 150 is held in place by the pair of support arms 16. Particularly, the mounting coupling 120 captures the end cap 170 and end cap cover 188 located at each end of the light element 150, thereby holding the light element 150 in place.

Figure 11:
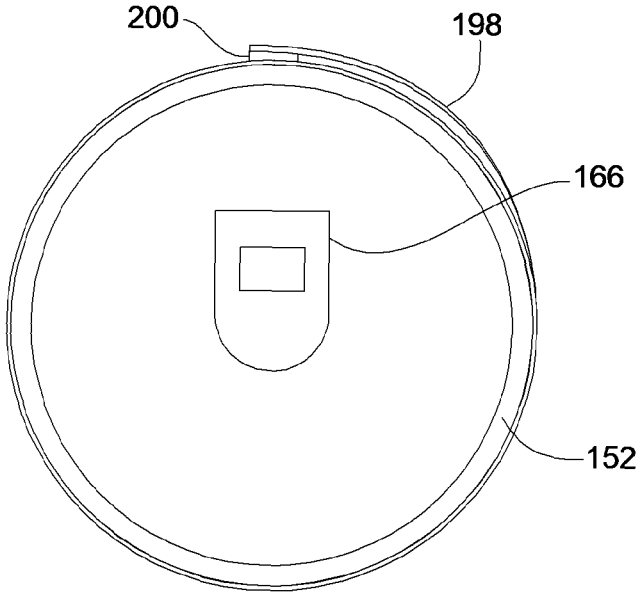
FIG. 11 is a side view of a light shade and light tube of the light element of FIG. 10.

Turning now to FIG. 11, the light tube 152 is shown covered by the light shade 198. The light shade 198 has an adhesive strip 200 such that it may be affixed to itself after being coiled around the light tube 152 and overlapping itself. The light shade 198 is constructed of a polymer film material, and may be supplied clear, as a solid color, and/or with printed graphics thereon. The light shade 198 may also be supplied as a solid color with a clear portion, i.e. a lens area, thereby allowing a greater intensity of light to be focused through the clear portion and directed at the retail merchandise 15 (See FIG. 1).

The light shade 198 is designed to be only slightly larger in diameter than the light tube 152, allowing the light shade 198 to be axially rotated with respect to the light tube 152. However, the light shade 198 shall be sufficiently tight about light tube 152 to maintain the angular orientation of the light shade 198 relative to the light tube 152, when released by a user. However, the light shade 198 shall remain sufficiently loose to permit a user to adjust the angular position of the light shade 198 relative to the light tube 152. When the light shade 198 is supplied with a clear lens area, the light passing through the lens area may be directed by rotating the light shade 198. Although described as a polymer film material, the light shade 198 may also be supplied as a rigid extrusion and thereby act as a sleeve, sliding over the light tube 152. The light shade 198 thus not only provides the user with the capability to direct light in a selected direction, but also the capability to utilize various illuminated advertising options by virtue of color selection, printed messages and graphics. The light tube 152 may be constructed of a formed plastic, or other structurally rigid material. For instance, indicia of the type of products stored by the retail display system may be illuminated for viewing by the user. As illustrated in FIG. 9, the light shade, when illuminated, would read "SNACKS."

Figure 12:
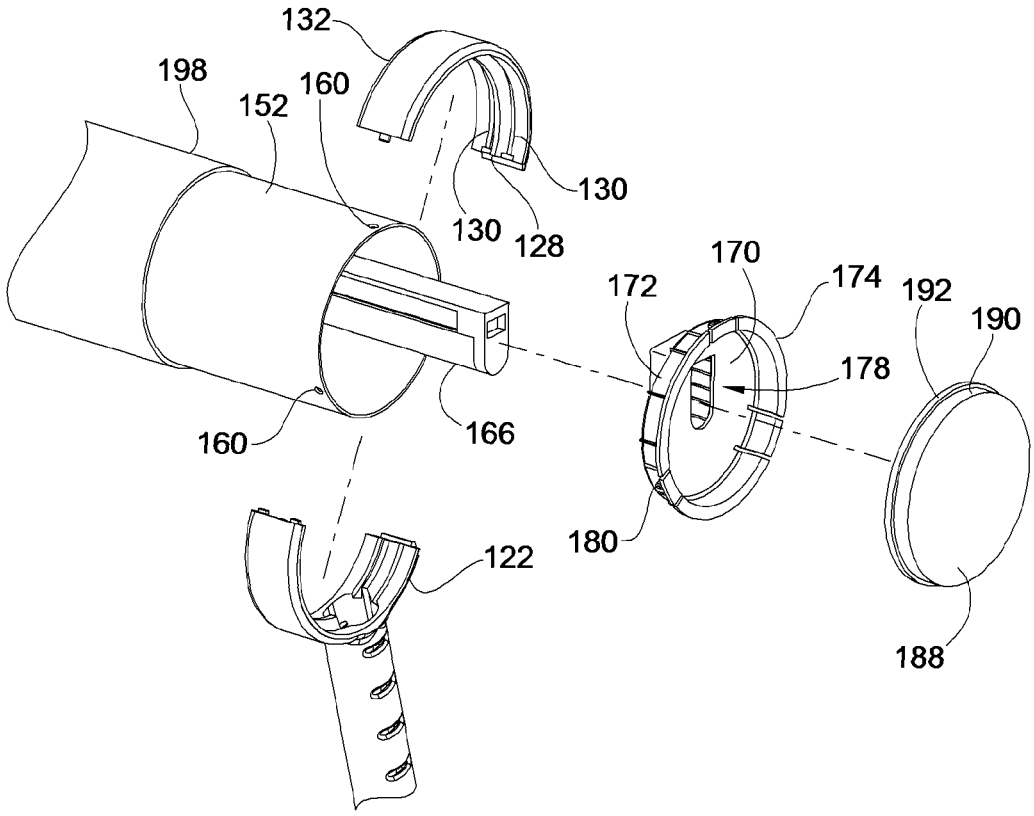
FIG. 12 is an assembly view of an end cap, end cap cover, and the light tube of FIG. 10.

Turning now to FIG. 12, the end mounting of the light element 150 is shown in an exploded view. When assembled, the light emitting device 166 is received by a light element mounting hole 178 of the end caps 170 located at either end of the light element 150. The end caps 170 have a plurality of projections 180 extending transversely from an inner annular wall 172. The light tube 152 has a corresponding plurality of holes 160 adapted to receive the plurality of projections 180. When the projections 180 are received by the holes 160, the end caps 170 are fixed to the light tube 152, and an inner annular wall 172 of the end cap 170 is received by the light tube 152. As stated above, the light emitting device 166 is received by the light element mounting hole 178 of the end caps 170, resulting in the light emitting device 166 being axially fixed and protected within the light tube once the end caps 170 are connected to the light tube 152. The end caps 170 are constructed of a formed plastic, metal, or other structurally rigid material.

The end caps 170 have an outer annular wall 174 extending radially outward beyond inner annular wall 172. The outer annular wall 174 is received by one of the channels 130 of the tube coupling 120. Once the light tube 152, light emitting device 166, and end caps 170 are assembled as described above, each outer annular wall 174 is placed in the portion of the channel 130 located on the mounting brackets 122 at either end of the light element 150.

The end cap cover 188 also has an inner annular wall 190, and an outer annular wall 192 extending radially outward from the inner annular wall 190. The outer annular wall 192 of the end cap cover 188 is received by the channel 130 not occupied by the outer annular wall 174 of the end cap 170. The rib 128 acts to maintain clearance between the end cap 170 and end cap cover 188. Once the end cap 170 and end cap cover 174 are received by the channels 130, the retaining bracket 132 may be joined to the mounting bracket 122 located at each end of the light element 150, thus forming the mounting coupling 120. The end caps 188 thereby cap and protect the ends of the light tube 152.

Figure 13:
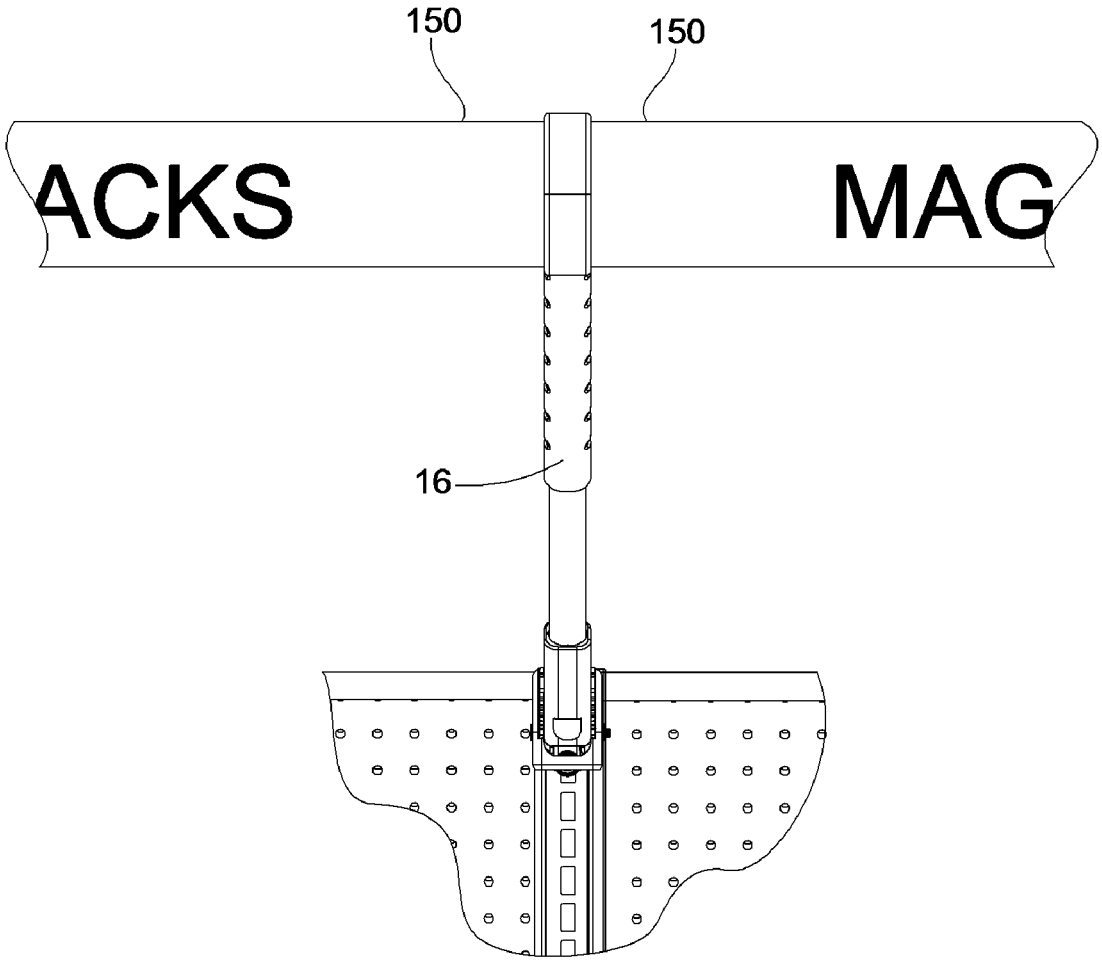
FIG. 13 is a adjustable retail light incorporating multiple light elements of FIG. 10.

Referring now to FIGS. 12 and 13, an alternative arrangement of the adjustable retail light 14 incorporates adjacent light elements 150 such that they share a common support arm 16 and are thus "chained" together. In this chained configuration, adjacent retail lights 14 may be electrically coupled such that only a single power cord need be provided to power the chain of retail lights 14. In such an embodiment, the adjustable retail light 14 utilizes three or more support arms 16. Each support arm 16 that is common to two light elements 150 does not incorporate the use of an end cap cover 188 as described above. Instead, the end cap cover 188 is omitted and substituted with another light element 150. As such, one channel 130 of the mounting coupling 120 of the common support arm 16 receives an outer annular wall 174 of one light element 150, while the adjacent channel 130 does the same of another light element 150. This is accomplished by virtue of the adjacent channels 130 of the mounting coupling 120. The support arms 16 located at either end of the chained assembly still incorporate the use of end cap covers 188. In this embodiment, the light shades 198 can incorporate differing graphical indicators, for example, one light shade 198 may incorporate printed graphics reading "SNACKS," while another light shade 198 may incorporate printed graphics reading "MAGAZINES."

Figure 14:
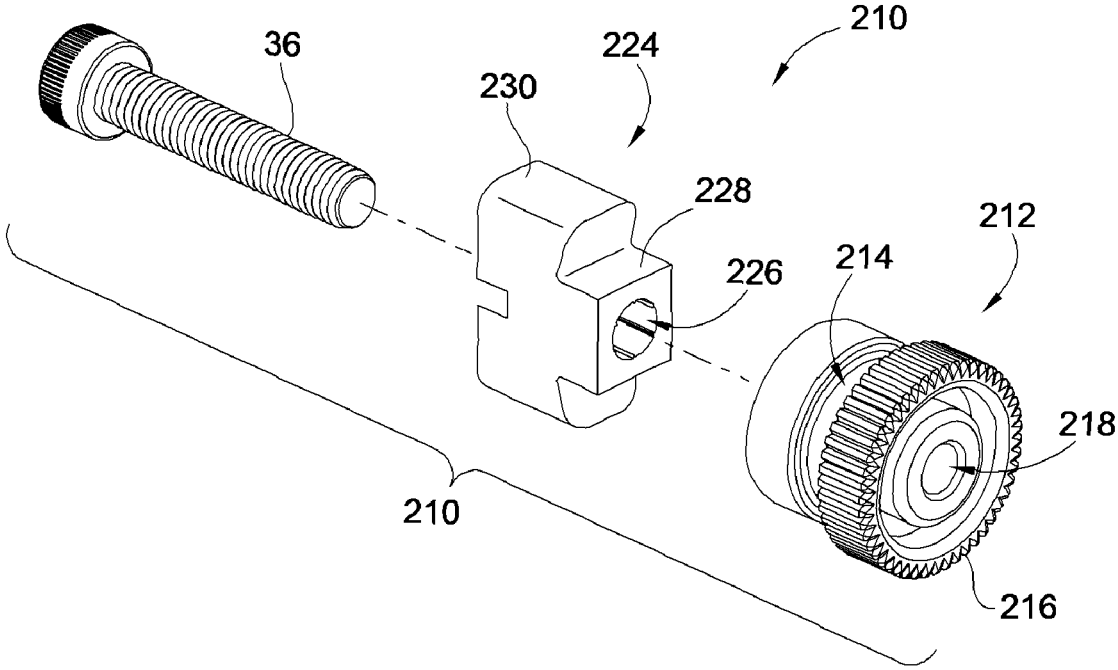
FIG. 14 is an assembly view of a mounting key assembly of the adjustable retail light of FIG. 2.

Turning now to FIG. 14, an embodiment of a mounting key assembly 210 is illustrated as having a knob 212 and a retaining member 224 joined by a bolt 36. The knob 212 has a generally cylindrical body with a threaded bore 218 located at its central axis. Located on the cylindrical body is an annular channel 214. The retaining member 224 has a neck portion 228 and a retaining portion 230. As illustrated, the retaining member has a generally "T" shaped profile. The retaining member 224 has a bore 226 passing through its central axis. The bore 226 is sized to receive the bolt 36 in a slip fit orientation such that the bolt 36 passes through the retaining member 224, and the retaining portion 230 is in contact with the head of the bolt 36. The knob 212 is threaded onto the exposed threads of the bolt 36 extending past the retaining member 224. The knob 212 and retaining portion 230 are constructed of a formed plastic, metal, or other structurally rigid material.

Figure 15:
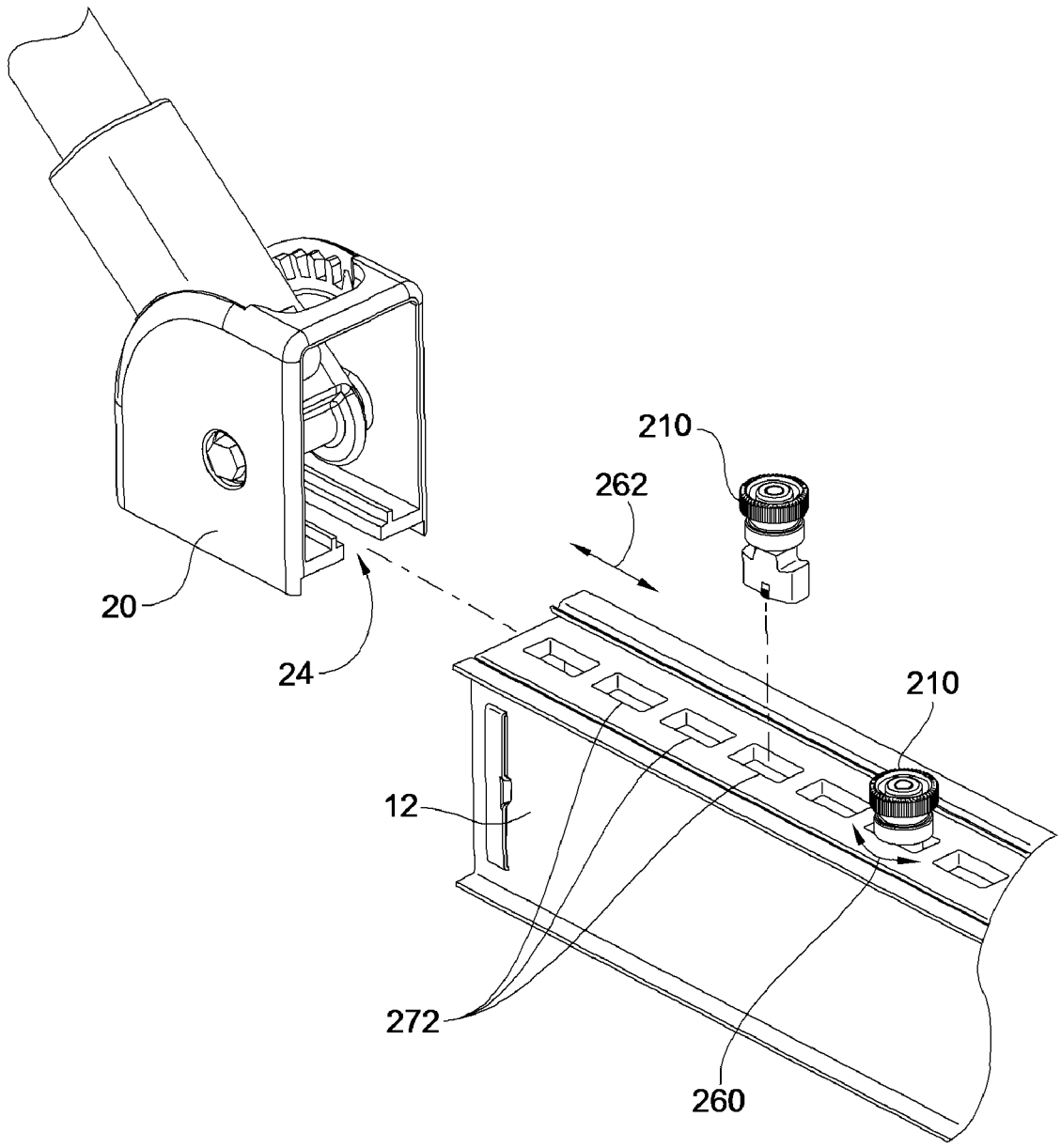
FIG. 15 is an assembly view of the mounting key assemblies and a vertical retail wall of the adjustable arm gondola lighting system of FIG. 1.

Referring simultaneously to FIGS. 7, 14 and 15, the mounting key assemblies 210 are shown in relationship to the vertical retail wall 12 and the bracket housing 20. As illustrated, the mounting key assemblies 210 are inserted into apertures 272 such that the retaining portion 230 passes through an aperture 272 and knob 212 is flush with the vertical retail wall 12. The mounting key assemblies 210 are then rotated 90° in direction 260. Once rotated, the retaining portion 230 of each mounting key assembly 210 may no longer pass through the aperture 272 it was previously inserted in without again being rotated 90° in direction 260.

Once the mounting keys 210 are installed, the bracket housing 20 is moved in direction 262 until the open ended slot 24 encompasses the mounting key assemblies 210. As shown in FIG. 7, the open ended slot 24 of the bracket housing 20 has a closed end such that the bracket housing 20 may be moved in direction 262 until the closed end 23 of the open ended slot 24 and the mounting key assembly 210 are in contact with one another. The open ended slot 24 has a wall thickness adapted to be received within the annular channel 214 of the mounting key assembly such that the bracket housing is prevented from movement in the axial direction of the mounting key assemblies. In the illustrated embodiment, each bracket housing 20 is affixed to the vertical retail wall 12 via two mounting key assemblies 210 to prevent twisting of the bracket housing 20, however, in other embodiments, one mounting key assembly 210 may be utilized per bracket housing 20. In the illustrated embodiment of FIG. 15, the remainder of the adjustable support arm 16 and light element 150 have been omitted for clarity purposes only. The adjustable retail light 14 may be fully assembled first and then mounted to the vertical retail wall 12 via the mounting key assemblies 210, or as illustrated, the bracket housings 20 may be installed on the vertical wall 12, and the rest of the adjustable retail light 14 assembled thereafter. Also in other embodiments, the mounting key assemblies 210 may be omitted entirely, and the bracket housings 20 may be affixed to a flat surface that is not necessarily a vertical retail wall via other hardware such as socket head cap screws or similar hardware.

As illustrated in FIGS. 4-12 and as described above, in a preferred embodiment, once assembled, the axial bores 52, 76, 92, 108 of the locking sleeve 50, the inner arm member 68, the locking clip 86, and the outer arm member 102 are concentric and collinear with one another, and therefore share a common central axis. A power cord connected to the light emitting device 166 passes through the light element mounting hole 178 of the end cap 170. The power cord is then routed through the axial bores 52, 76, 92, 108 of the outer arm member 102, the locking clip 86, the inner arm member 68, the locking sleeve 50, and finally out of the power cord opening 58. The cord is then routed independently of the adjustable retail light 14 to a power source. This arrangement hides the power cord giving the retail light 14 an improved appearance.

Figure 16:
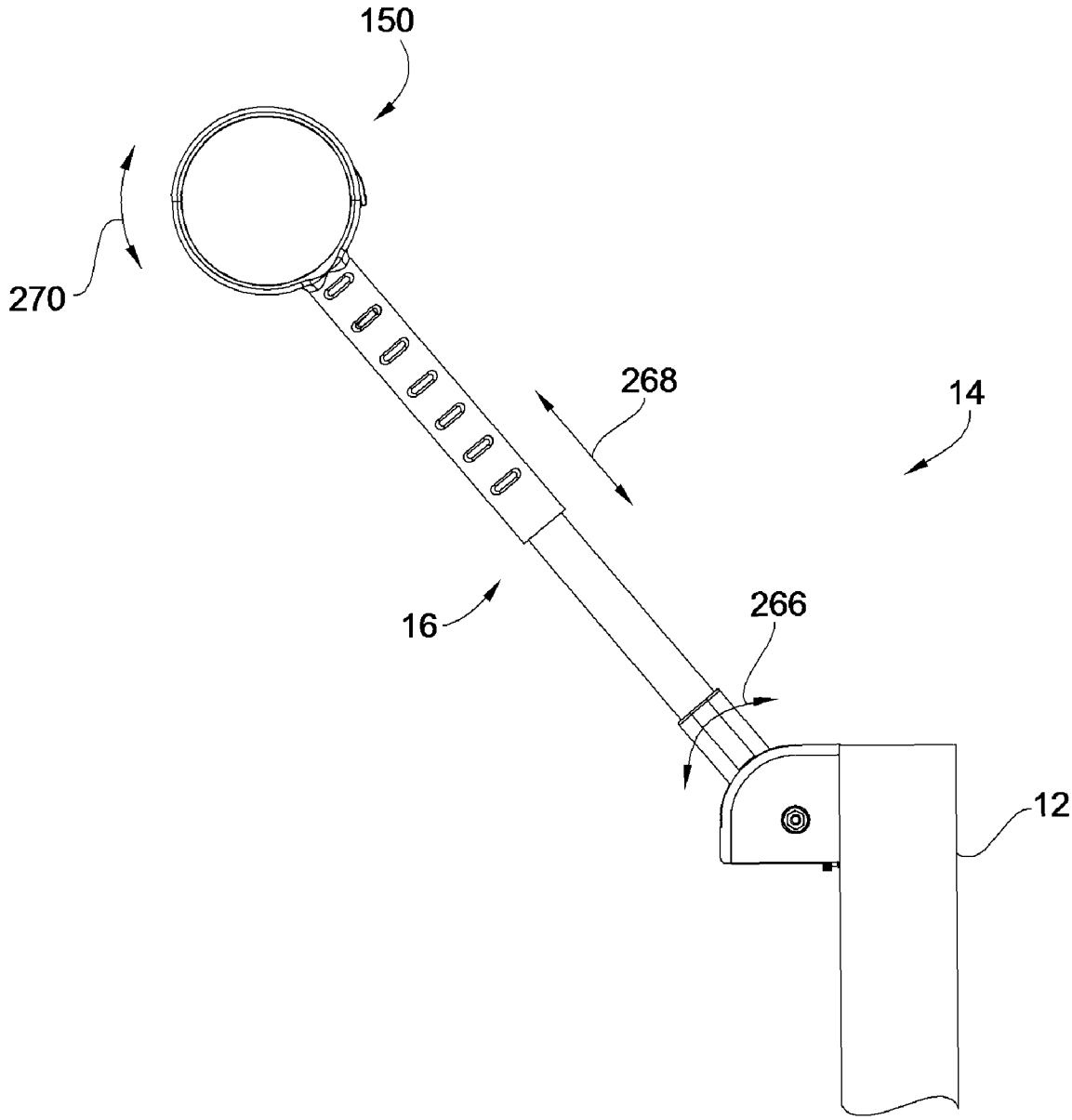
FIG. 16 is a side view of the adjustable retail light of FIG. 2.

Referring simultaneously to FIGS. 3 and 16, the adjustable retail light 14 may be adjusted along three degrees of freedom including angularly along direction 266, linearly along direction 268, and angularly along direction 270. To angularly adjust the adjustable retail light 14 along direction 266, a user first removes the bolt 44 from the mounting brackets 18 thereby separating the bracket housings 20 and locking sleeves 50. The locking sleeve 50 is then repositioned within the sleeve chamber 42 such that the keyed projections 54 located on either side of each locking sleeve are inserted into corresponding adjacent serrated projections 34 located on the inner faces 32 of each bracket housing 20. The bolt 44 is then reinserted and fastened, thereby rejoining the locking sleeve 50 and bracket housing 20 in the new desired angular orientation.

Although illustrated and described above as utilizing a gear like arrangement to angularly position the locking sleeve 50 relative to the bracket housing 20, in other embodiments, the inner arm member 68 may be angularly positioned with respect to the bracket housing 20 by other mechanical arrangements, such as introducing a frictional force between the bracket housing 20 and the inner arm member 68, or the bracket housing and the locking sleeve 50.

To adjust the adjustable retail light 14 along direction 268, a user pushes radially inward on the locking tabs 96 of the locking clip 86 such that the outer arm member 102 is no longer prevented from axial translation. The outer arm member 102 is then moved along direction 268 until the locking tabs 96 are positioned within another pair of corresponding slotted openings 110 on the outer arm member 102. The locking tabs 96 are then returned to their radially neutral position, and the outer arm member 102 is again prevented from axial movement along direction 268.

Although illustrated and described as utilizing a locking clip 86 having locking tabs 96 received by slotted openings 110, in other embodiments, the axial length of the adjustable support arms 16 may be selectably interlocked by other mechanical arrangements, such as a set screw adapted to thread through the wall of the outer arm member 102, and frictionally contact the inner arm member 68.

When a light shade 198 that incorporates a lens area as discussed above, the light passing through the lens area may be angularly adjusted along direction 270 to aim or focus the light. Also, the light shade 198 may be angularly adjusted along direction 270 to ensure that any printed graphics thereon are easily viewable by a potential customer.

While the adjustable support arm 16 is illustrated and described as having a generally circular cross sectional profile, in other embodiments the adjustable support arm 16 is not limited to a circular cross section, and may have other cross sectional profiles, e.g. rectangular, elliptical, etc. Further, the axial bores 52, 76, 92, 108 of the locking sleeve 50, inner arm member 68, locking clip 86, and outer arm member 108 are not limited to their respective circular peripheries as illustrated, and in other embodiments, axial bores 52, 76, 92, 108 may have non circular peripheries, e.g. rectangular, elliptical, etc.

As described herein, the adjustable arm gondola lighting system incorporates an adjustable retail light 14 that may be adjusted linearly and angularly. The adjustable retail light 14 integrates retail merchandise advertising and directional lighting capabilities, thereby presenting a consumer with an aesthetically pleasing yet functional appearance, and is designed for quick and cost effective assembly and adjustment.

Figure 17:
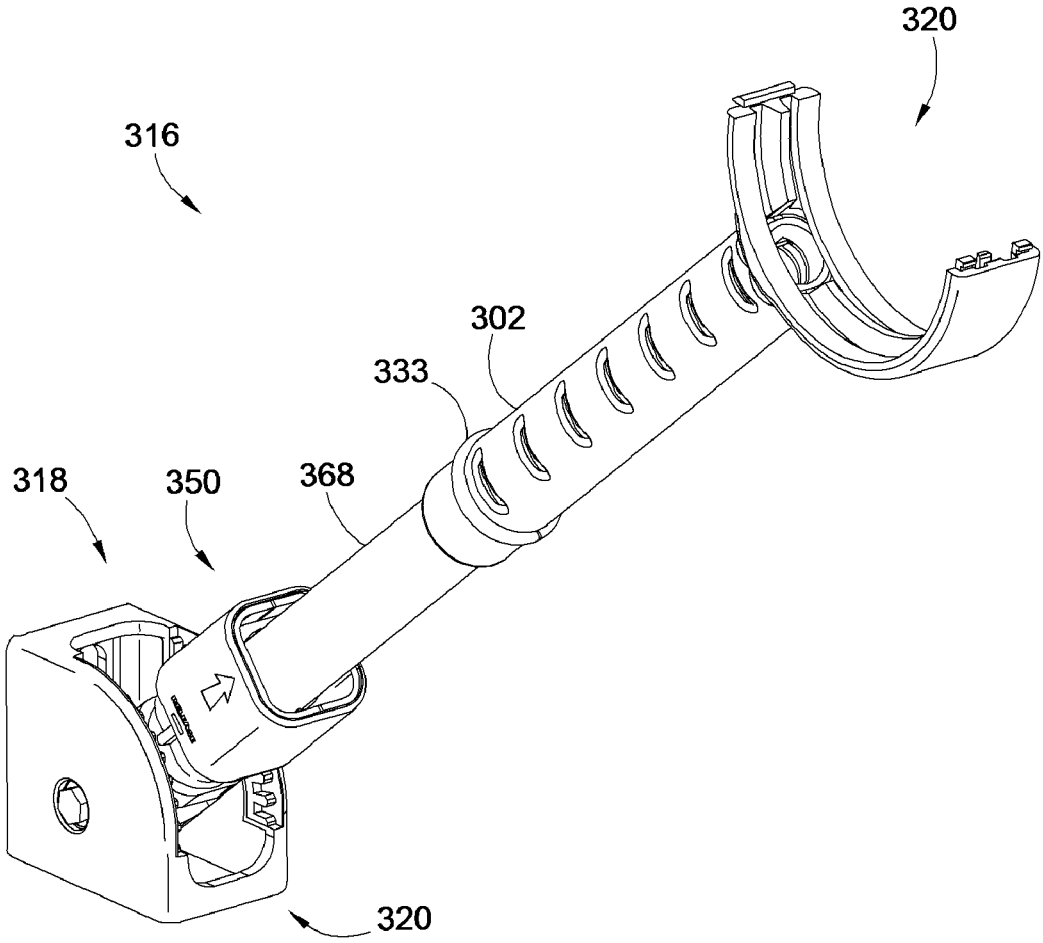
FIG. 17 is an isometric illustration of a further embodiment of an adjustable support arm according to the teachings of the present invention.
Figure 18:
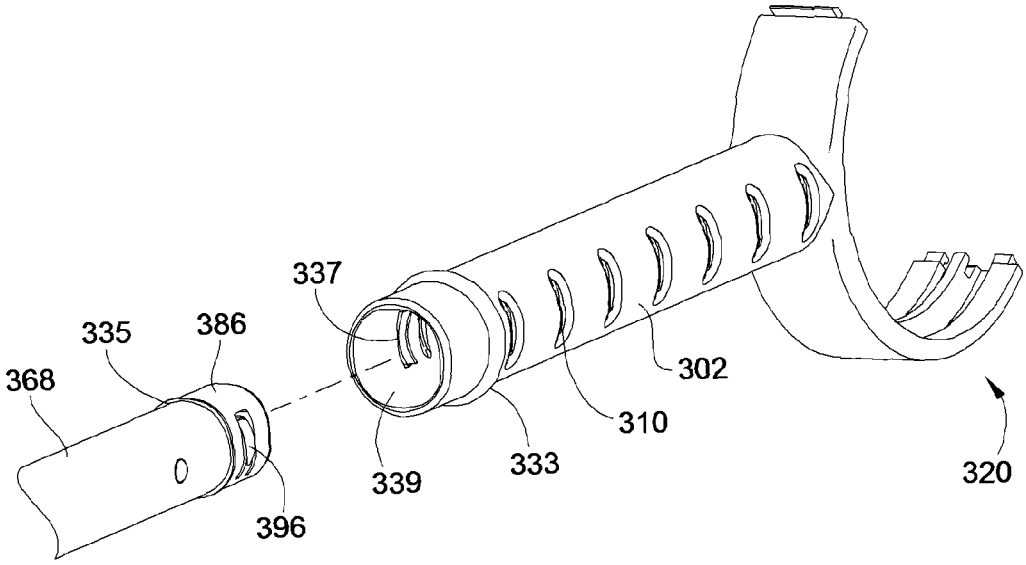
FIG. 18 is a partial exploded view of the inner and outer arm members of the adjustable support arm of FIG. 17 illustrating the locking ring.

FIG. 17 illustrates a further embodiment of an adjustable support arm 316 for an adjustable gondola light according to the teachings of the present invention. The adjustable support arm 316 is substantially similar to the previous embodiments, but includes additional features that could also be implemented, together or individually, in the previously described embodiments.

Similar to previous embodiments, the adjustable support arm 316 generally includes a mounting bracket assembly 318, an inner arm member 368 and an outer arm member 302.

The adjustable support arm 316 includes a locking arrangement that prevents undesired separation of the inner arm member 368 from the outer arm member 302 when adjusting the length of the adjustable support arm 316 by telescoping the two arm members 368, 302 relative to one another.

The locking arrangement in the illustrated embodiment is provided by locking ring 333 and radially extending wall 335 of locking clip 386. The radially extending wall 335 extends radially outward beyond the outer periphery of inner arm member 368 and axially engages with locking ring 333 to prevent the inner arm member 368 from being withdrawn from outer arm member 302.

The locking ring 333 includes a plurality of radially inward projecting catches 337 that extend through an aperture formed in the annular wall of inner arm member 368 radially inward beyond an inner surface 339 of the annular wall. As such, when the locking clip 386 and inner arm member 368 are received by the outer arm member 302 with the locking clip 386 axially positioned between the mounting coupling 320 and locking ring 333, the catches 337 will axially interfere with wall 335 and prevent removal of the inner arm member 368 from outer arm member 302.

Preferably, locking ring 333 is a split ring such that it can be easily mounted to outer arm member 302. Additionally, the locking ring 333 need only include one catch 337 or could include more than two catches. Further, alternative locking arrangement could be employed to prevent accidental removal of the inner arm member 368 from the outer arm member 302 when adjusting the axial length of the adjustable support arm 316.

For example, locking clip 386 could include a second projection that aligns with the portion of the outer arm member 302 that is free of slotted openings 310. That region would include a slotted opening (not shown) proximate the open end of outer arm 302 through which a second locking tab (not shown) angularly spaced from slotted tabs 396 that would interact with that slotted opening.

Figure 19:
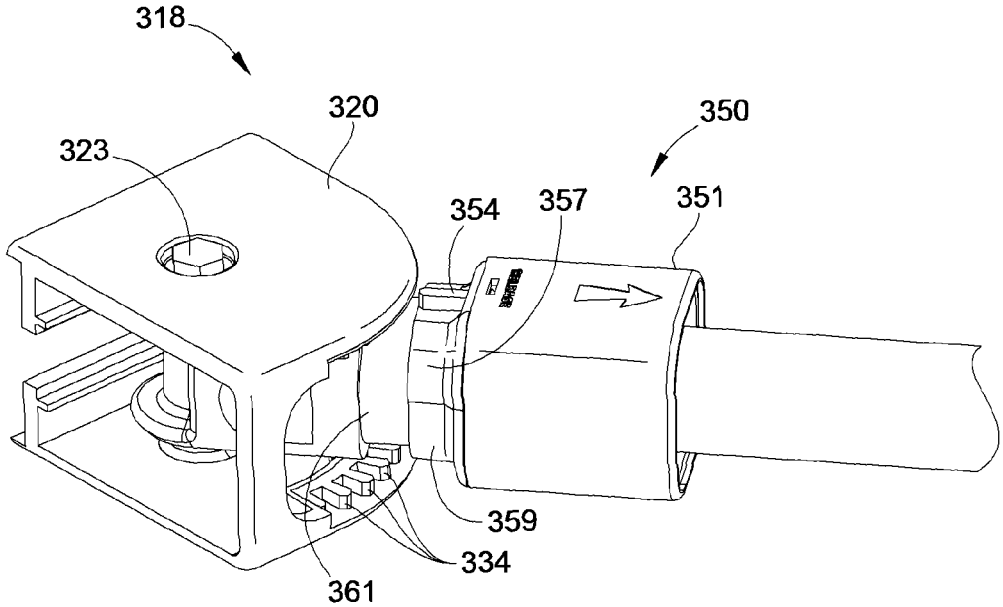
FIG. 19 is a partial isometric illustration of the mounting bracket assembly of the adjustable support arm of FIG. 17.

The locking mounting bracket assembly 318 includes a bracket housing 320 and a spring loaded locking sleeve 350. With reference to FIG. 19, the mounting bracket assembly 318 permits for angularly adjusting the position of the support arm. Like the previous embodiments, the locking sleeve 350 includes a pair of keyed projections 354 in opposed spaced relation to one another extending outward. The keyed projections 354 interact with the plurality of serrated projections 334 much like in the previous embodiments.

Figure 20:
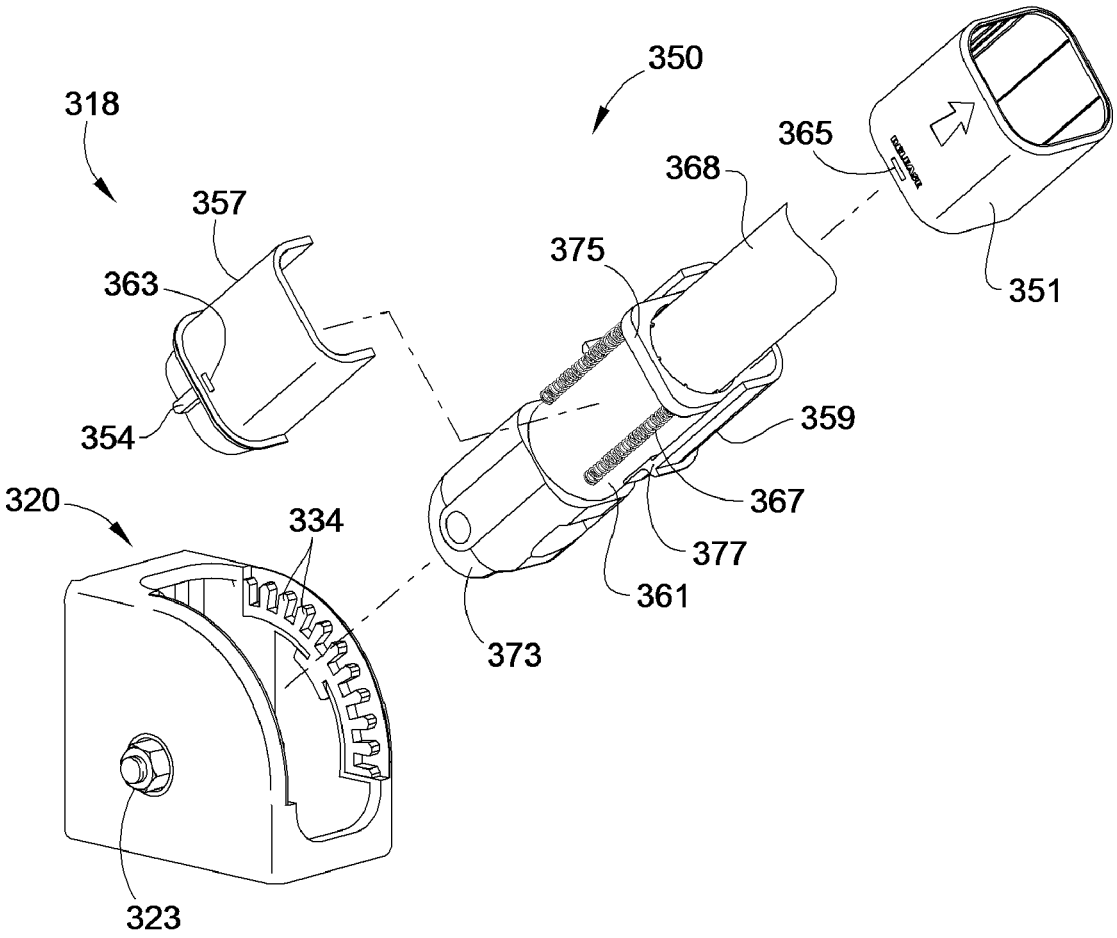
FIG. 20 is a partial exploded illustration of the mounting bracket assembly of FIG. 19.

With further reference to FIG. 20, in this embodiment, the locking sleeve 350 is spring loaded such that the user need not release bolt 323 to adjust the angular position of the locking sleeve 350 relative to bracket housing 320.

The locking sleeve 350 is an assembly of components that further includes a retaining ring 351 a pair of sliding locking members 357, 359 and a support body 361. When assembled, the sliding locking members 357, 359 surround support body 361. Retaining ring 351 surround the sliding locking members 357, 359 and secure the sliding locking members 357 about support body 361. The sliding locking members 357, 359 and retaining ring 351 include cooperating engagement structure to axially secure the components together. In the illustrated embodiment, the cooperating engagement structure is in the form of projection 363 of the sliding locking members 357, 359 and cooperating aperture 365 of the retaining ring 351.

A plurality of coil springs 367 are interposed between the sliding locking members 357, 359 and the support body 361 to bias the sliding locking members 357, 359 towards the mounting end 373 of the support body 361. More particularly, spring member acts between outward extending wall 375 of the support body 361 and inward extending wall 377 of the sliding locking members 357. This biasing action towards mounting end 373 biases the keyed projections 354 into engagement with serrated projections 334.

When a user desires to adjust the angle of the locking sleeve 350 relative to the housing bracket 320, the user merely pulls axially on retaining ring 351 away from mounting end 373 and disengages keyed projections 354 from serrated projections 334. When disengaged, the locking sleeve 350 is permitted to rotate angularly about bolt 323. Once the locking sleeve 350, and coincidentally the inner and outer arm members, is in the desired angular orientation, the user releases the retaining ring 351 such that the retaining ring 351 and connected sliding locking members 357, 359 transition axially towards mounting end 373 under biasing force provided by coil springs 367. When sufficiently biased towards the mounting end 373, the keyed projections 354 will once again engage serrated projections 334 and maintain the angular position of the locking sleeve 350 relative to housing bracket 320.

Figure 21:
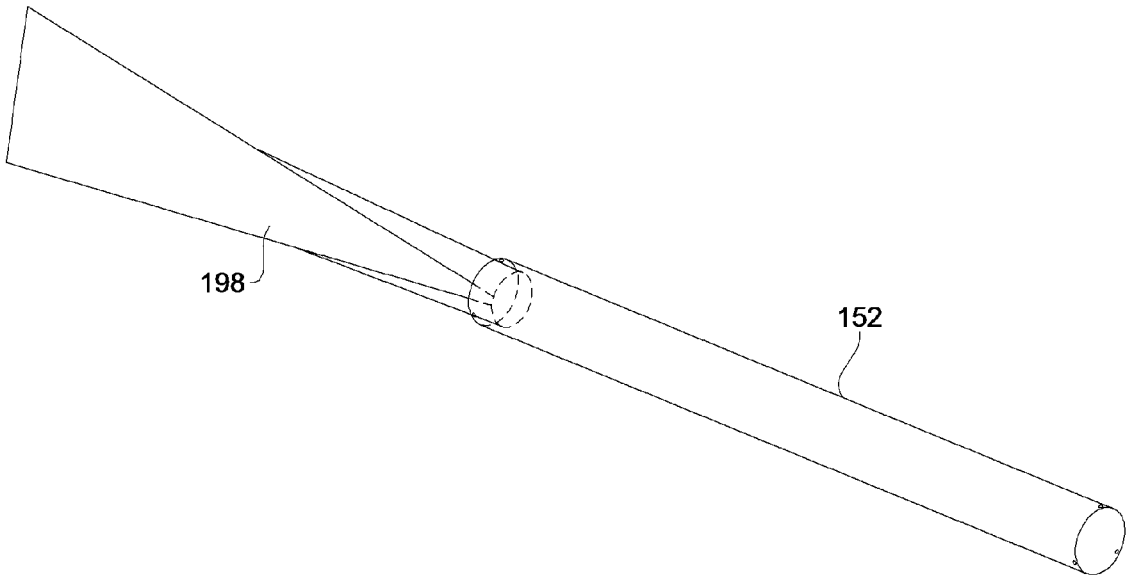
FIG. 21 is an alternative arrangement for mounting the light shade to a light element.

FIG. 21 illustrates an alternative arrangement of mounting the light shade 198 to the light tube 152. In this embodiment, the light shade 198 is positioned within the light tube 152 rather than wrapped around the light tube 152, as illustrated previously. As such, the user will typically take an originally flat piece of light shade material and wrap or coil one end 153 of the light shade 198 such that it can be axially inserted into light tube 152. The user will then axially feed the light shade 198 into the light tube 152. Once fully fed into the light tube 152, the light shade 198 will attempt to return to its flat shape and attempt to un-wrap/un-coil (un-wrap and un-coil can be used interchangeably) such that it substantially aligns with the inner surface of the light tube 152. In this arrangement, the light shade 198 will be radially interposed between the light tube 152 and any light emitting device (not shown) positioned within the light tube 152.

The light shade 198 is preferably angularly positionable within the light tube 152 to permit additional focusing adjustability of the light emitted through the light tube and shade combination.

Preferably, the light shade 198 in any embodiment will surround at least 180 degrees of any light emitting device of the gondola light. However, in other embodiments, the light shade 198 will surround 270 degrees of any light emitting device. In further embodiments, the light shade 198 will entirely surround any light emitting device.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context

What is claimed is:

1. An adjustable retail light comprising:

at least one adjustable support arm;

at least one light element operatively connected to and supported by the at least one adjustable support arm;

at least one light shade conforming, at least in part, to the light element and being supported thereby;

wherein the at least one light shade overlaps itself thereby having two overlapping portions, whereby the two overlapping portions are secured to one another to secure the at least one light shade about the at least one light element;

wherein the at least one light element comprises a light tube and a light emitting device within a cavity of the light tube, a light shade inner surface contacting an outer surface of the light tube;

wherein the at least one adjustable support arm includes a pair of adjustable support arms, and wherein the at least one light element is interposed between and supported by the pair of adjustable support arms;

further comprising a pair of end caps, said pair of end caps each having an inner annular wall portion and an outer annular wall portion positioned radially outward from the inner annular wall portion, one end of the cavity of the light tube receiving the inner annular wall portion of one of the end caps and the other end of the cavity of the light tube receiving the inner annular wall portion of the other one of the end caps; and each of the pair of adjustable support arms further including an annular light element coupling defining an annular channel in an inner surface of the annular light element coupling, each annular channel rotatably receiving the outer annular wall portion of one of the end caps.

2. An adjustable retail light comprising:

at least one adjustable support arm having a mounting bracket, wherein the mounting bracket is operatively connected to an end of the at least one adjustable support arm;

at least one light element operatively connected to and supported by the at least one adjustable support arm;

wherein the at least one adjustable support arm has a selectably adjustable axial length;

wherein the at least one adjustable support arm is selectably angularly positionable with respect to the mounting bracket;

wherein the at least one adjustable support arm comprises an inner arm member and an outer arm member, the outer and inner arm members each having a first end and a second end, wherein the second end of the outer arm member has a first axial bore slidably receiving the first end of the inner arm member, and wherein the outer arm member is selectably interlockable with the inner arm member to selectably maintain the selected length of the at least one adjustable support arm;

further including a locking clip extending between first and second ends, the first end of the locking clip including a projection extending radially outward;

wherein the inner arm has a second axial bore, the second end of the locking clip received in the axial bore with the first end of the locking clip extending axially away from the inner arm member;

wherein the outer arm member has a plurality of openings passing through a sidewall thereof into the first axial bore, the plurality of openings arranged in a linear array along an axial length of the outer arm member; and wherein the first axial bore slidably receives the locking clip and the inner arm member, the projection selectively engageable with one opening of the plurality of openings to prevent axial movement of the outer arm member relative to the inner arm member.

3. The adjustable retail light of claim 2 including a secondary locking arrangement to prevent axial removal of the inner arm from the outer arm, the secondary locking arrangement only preventing axial removal when the locking clip is about to removed from the outer arm.

4. An adjustable retail light comprising:

at least one adjustable support arm having a mounting bracket, wherein the mounting bracket is operatively connected to an end of the at least one adjustable support arm;

at least one light element operatively connected to and supported by the at least one adjustable support arm;

wherein the at least one adjustable support arm has a selectably adjustable axial length;

wherein the at least one adjustable support arm is selectably angularly positionable with respect to the mounting bracket;

wherein the at least one adjustable support arm includes an inner arm member, and an outer arm member, the outer and inner arm members each having a first end and a second end;

wherein the mounting bracket includes a bracket housing and a locking sleeve, the locking sleeve axially receiving a second end of the inner arm member, the locking sleeve being selectively angularly positionable relative to the bracket housing to facilitate angularly positioning the at least one support arm relative to the mounting bracket; and wherein the bracket housing has a pair of side walls each having an inner and an outer face, wherein the pair of side walls are in opposed spaced relation to one another, the inner face of each of the pair of side walls having a plurality of angularly spaced apart projections forming grooves therebetween, the locking sleeve operatively connected to the bracket for angular rotation about an axis that is generally perpendicular to the pair of side walls, the locking sleeve including a projection extending outward from an outer surface of the locking sleeve, wherein the projection of the locking sleeve is selectably received within a groove between two adjacent projections of the bracket housing to maintain the angular position of the locking sleeve relative to the locking housing.

5. The adjustable retail light of claim 4, wherein the locking sleeve is a spring loaded assembly wherein the projection of the locking sleeve is biased towards the bracket housing, but is axially slidable away from the bracket housing when the biasing force is overcome to disengage the projection of the locking sleeve from the angularly spaced apart projections to permit angular positioning of the locking sleeve relative to the bracket housing.

6. An adjustable retail light comprising:

at least one adjustable support arm having a mounting bracket, wherein the mounting bracket is operatively connected to an end of the at least one adjustable support arm;

at least one light element operatively connected to and supported by the at least one adjustable support arm;

wherein the at least one adjustable support arm has a selectably adjustable axial length;

wherein the at least one adjustable support arm is selectably angularly positionable with respect to the mounting bracket;

wherein the light element is angularly rotatable relative to the at least one adjustable support arm;

wherein the at least one adjustable support arm includes a pair of adjustable support arms, and wherein the at least one light element is interposed between and supported by the pair of adjustable support arms;

further comprising a pair of end caps, said pair of end caps each having an inner annular wall portion and an outer annular wall portion positioned radially outward from the inner annular wall portion, one end of the cavity of the light tube receiving the inner annular wall portion of one of the end caps and the other end of the cavity of the light tube receiving the inner annular wall portion of the other one of the end caps; and each of the pair of adjustable support arms further including an annular light element coupling defining an annular channel in an inner surface of the annular light element coupling, each annular channel rotatably receiving the outer annular wall portion of one of the end caps permitting the angular rotation of the light element relative to the adjustable support arms.

7. An adjustable retail light comprising:

at least one adjustable support arm;

at least one light element operatively connected to and supported by the at least one adjustable support arm;

at least one light shade conforming, at least in part, to the at least one light element and being supported thereby;

wherein the at least one adjustable support arm includes a pair of adjustable support arms, and wherein the at least one light element is interposed between and supported by the pair of adjustable support arms;

the adjustable retail light further comprising a pair of end caps, said pair of end caps each having an inner annular wall portion and an outer annular wall portion positioned radially outward from the inner annular wall portion, one end of the cavity of the light tube receiving the inner annular wall portion of one of the end caps and the other end of the cavity of the light tube receiving the inner annular wall portion of the other one of the end caps; and each of the pair of adjustable support arms further including an annular light element coupling defining an annular channel in an inner surface of the annular light element coupling, each annular channel rotatably receiving the outer annular wall portion of one of the end caps.

8. An adjustable retail light comprising:

at least one adjustable support arm having a mounting bracket, wherein the mounting bracket is operatively connected to an end of the at least one adjustable support arm;

at least one light element operatively connected to and supported by the at least one adjustable support arm;

wherein the at least one adjustable support arm has a selectably adjustable axial length, wherein the at least one adjustable support arm comprises an inner arm member and an outer arm member, the outer and inner arm members each having a first end and a second end, wherein the second end of the outer arm member has a first axial bore slidably receiving the first end of the inner arm member;

wherein the at least one adjustable support arm is selectably angularly positionable with respect to the mounting bracket;

the adjustable retail light further comprising a locking clip extending between first and second ends, the first end of the locking clip including a projection extending radially outward;

wherein the inner arm has a second axial bore, the second end of the locking clip received in the axial bore with the first end of the locking clip extending axially away from the inner arm member;

wherein the outer arm member has a plurality of openings passing through a sidewall thereof into the first axial bore, the plurality of openings arranged in a linear array along an axial length of the outer arm member; and wherein the first axial bore slidably receives the locking clip and the inner arm member, the projection selectively engageable with one opening of the plurality of openings to prevent axial movement of the outer arm member relative to the inner arm member.

9. An adjustable retail light comprising:

at least one adjustable support arm having a mounting bracket, wherein the mounting bracket is operatively connected to an end of the at least one adjustable support arm, and wherein the mounting bracket includes a bracket housing and a locking sleeve, the locking sleeve axially receiving a second end of the inner arm member, the locking sleeve being selectively angularly positionable relative to the bracket housing to facilitate angularly positioning the at least one support arm relative to the mounting bracket;

at least one light element operatively connected to and supported by the at least one adjustable support arm;

wherein the at least one adjustable support arm has a selectably adjustable axial length; and wherein the at least one adjustable support arm is selectably angularly positionable with respect to the mounting bracket;

wherein the bracket housing has a pair of side walls each having an inner and an outer face, wherein the pair of side walls are in opposed spaced relation to one another, the inner face of each of the pair of side walls having a plurality of angularly spaced apart projections forming grooves therebetween, the locking sleeve operatively connected to the bracket housing for angular rotation about an axis that is generally perpendicular to the pair of side walls, the locking sleeve including a projection extending outward from an outer surface of the locking sleeve, wherein the projection of the locking sleeve is selectably received within a groove between two adjacent projections of the bracket housing to maintain the angular position of the locking sleeve relative to the locking housing.

* * * * *